US006051924A

United States Patent [19]

Whalin et al.

[11] Patent Number: 6,051,924

[45] Date of Patent: Apr. 18, 2000

[54] FIELD EMISSION DEVICE HAVING COMPONENT CAPTURE FRAME

[75] Inventors: Jeffery A. Whalin, Fountain Hills; Arthur J. Ingle, Chandler; Charles A. Rowell, Tempe, all of Ariz.

[73] Assignee: Motorola, Inc., Schaumburg, Ill.

[21] Appl. No.: 09/098,841

[22] Filed: Jun. 17, 1998

[51] Int. Cl.[7] ..... H01J 63/04

[52] U.S. Cl. ..... 313/495; 313/309; 313/336; 313/351

[58] Field of Search ..... 313/495, 304, 313/336, 351

*Primary Examiner*—Vip Patel

*Attorney, Agent, or Firm*—Jasper Dockrey; Kevin D. Wills

[57] ABSTRACT

A field emission device (100, 200) includes a cathode plate (102) having a plurality of electron emitters (532), an anode plate (104) disposed to receive electrons emitted by plurality of electron emitters (532), a frame (109) interposed between cathode plate (102) and anode plate (104) and defining a central opening (112), a mating member (110, 210, 310, 410, 510) coextensive with frame (109) and disposed within central opening (112), and a getter structure (114, 214, 314, 414, 514, 614) mated with mating member (110, 210, 310, 410, 510).

48 Claims, 4 Drawing Sheets

FIELD EMISSION DEVICE HAVING COMPONENT CAPTURE FRAME

REFERENCE TO RELATED APPLICATION

Related subject matter is disclosed in a U.S. patent application entitled "Field Emission display Having a Mechanical Support/Getter Assembly and Method", having the application Ser. No. 08/811,653, filed on Mar. 5, 1997 and now U.S. Pat. No. 5,894,193 assigned to the same assignee.

1. Field of the Invention

The present invention relates, in general, to field emission devices, and, more particularly, to gettering structures for field emission devices.

2. Background of the Invention

Field emission devices are well known in the art. One type of field emission device is a field emission display. A field emission display includes an anode plate and a cathode plate that define a thin envelope. Typically, the anode plate and cathode are spaced apart at their peripheries by a frame.

It is known to use gettering material within field emission displays for the removal of undesirable gases. The configurations of prior art getters for field emission displays add unnecessary weight and volume to the device. In one prior art scheme, the gettering material is housed in a plenum, behind the cathode plate. The plenum is defined by an additional backplate, which adds unnecessary weight and volume to the display.

Further it is desired to contain components, such as getter structures, within a field emission device. However, the use of affixants can introduce undesirable gaseous contaminant into the vacuum environment of the device.

Accordingly, there exists a need for a field emission device having a gettering configuration, which does not require the use of affixants and which provides improved package weight and compactness over those of the prior art.

BRIEF DESCRIPTION OF THE DRAWINGS

Referring to the drawings.

Figure 1:
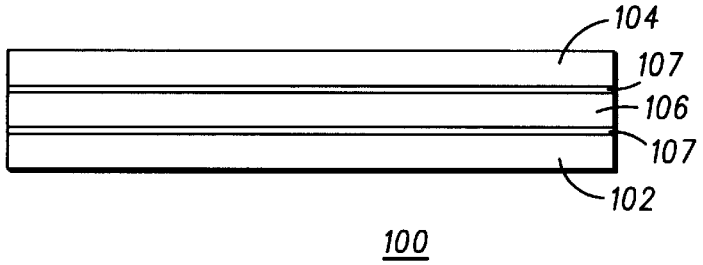
FIG. 1 is a side elevational view of a field emission device in accordance with a preferred embodiment of the invention.

It will be appreciated that for simplicity and clarity of illustration, elements shown in the drawings have not necessarily been drawn to scale. For example, the dimensions of some of the elements are exaggerated relative to each other. Further, where considered appropriate, reference numerals have been repeated among the drawings to indicate corresponding elements.

DESCRIPTION OF THE PREFERRED EMBODIMENTS

The invention is for a field emission device having a component capture frame. The component capture frame of the invention provides numerous advantages. For example, components are secured within the field emission device without the use of affixants, which otherwise can introduce contaminant gases into the vacuum environment of the device.

Furthermore, these components can be made from materials that are dissimilar to the materials of the frame, cathode plate, and anode plate of the device. For example, components having thermal expansion coefficients that are dissimilar to those of other package elements can be included without the risk of mechanical failures due to thermal mismatches.

Additionally, yield improvements are realized because the processes for fabricating the individual package elements (frame, getters, cathode plate, anode plate, and components) can be individually optimized. In this manner, the fabrication process for one package element need not be compromised due to the limitations, such at temperature limitations, of the other package elements. Also, greater design flexibility is realized due to the lack of rigid attachment of components to the frame.

FIG. 1 is a side elevational view of a field emission device (FED) 100 in accordance with a preferred embodiment of the invention. FED 100 includes a cathode plate 102 having a plurality of electron emitters (not shown) and an anode plate 104. For example, FED 100 can include a field emission display in which anode plate 104 has a plurality of phosphors (not shown) that are activated by the emitted electrons. Methods for fabricating cathode plates and anode plates for field emission devices are known to one skilled in the art.

FED 100 further includes a display frame 106. Display frame 106 is attached to cathode plate 102 and anode plate 104 with a sealant 107, such as a glass frit sealant. Display frame 106 is useful for maintaining a fixed separation distance between cathode plate 102 and anode plate 104.

Figure 2:
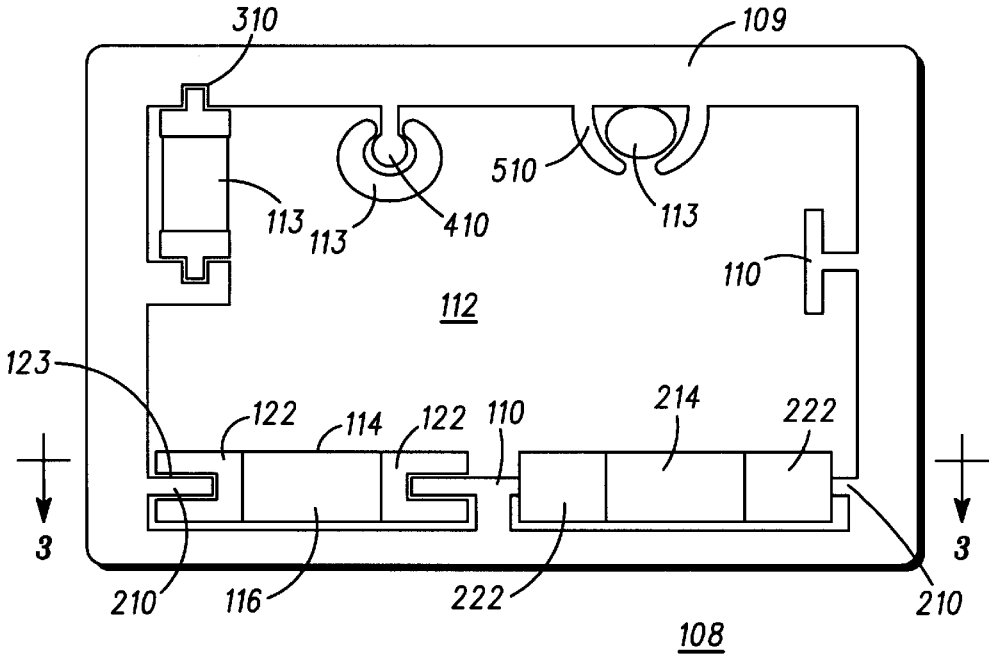
FIG. 2 is a top plan view of a component capture frame in accordance with the preferred embodiment of invention.

FIG. 2 is a top plan view of a component capture frame 108 in accordance with the preferred embodiment of invention. In the preferred embodiment, display frame 106 includes component capture frame 108. Component capture frame 108 has a frame 109, which defines a central opening 112. In general, frame 109 is made from a material that is thermally compatible with the other components of the package. Preferably, frame 109 is made from glass.

A component capture frame in accordance with the invention further includes at least one mating member. For ease of illustration, component capture frame 108 of FIG. 2 has several mating members, each of which embody the invention. It is desired to be understood that the particular number, shapes, and configurations of mating members embodying the invention are not limited to those illustrated in FIG. 2. For example, only one mating member can be included. Furthermore, a mating member embodying the invention can be configured outside of the central opening defined by the frame.

Illustrated in FIG. 2 are: a mating member 110, which is a tab; a mating member 210, which is a finger-like protrusion; a mating member 510, which is hook-shaped; a mating member 410, which is knob-shaped; and a mating member 310, which defines a notch. In accordance with the invention, each of mating members 110, 210, 510, 410, and 310 is coextensive with frame 109 and is shaped to be mated with at least one of a plurality of components 113.

Component capture frame 108 can be made by providing a sheet of glass and cutting the glass to form frame 109 and the mating members. The glass can be cut using a convenient glass-forming method, such as by cutting with a water knife, casting, laser ablation, etching, sand blasting, and the like.

Components 113 can include any of a number of discrete structures, which are required to be generally immovably configured within the vacuum envelope of FED 100. For example, components 113 include structures that function as sources or drains of chemical species.

Exemplary components, which are captured within component capture frame 108 of FIG. 2, are a getter structure 114 and a getter structure 214. Getter structure 114 includes a getter bar 116 having opposed ends. A retainer 122 is attached at each of the opposed ends. Within FED 100, retainer 122 makes physical contact with cathode plate 102 and with anode plate 104. Retainer 122 is useful for preventing relative displacement of getter structure 114 with respect to cathode plate 102 and anode plate 104. Retainer 122 is also a compressible structure. In the preferred embodiment, retainer 122 is made from a malleable material, such as a metal, which is also thermally compatible with the other package elements. For example, retainer 122 can be made from Alloy 48.

Each of retainers 122 define an opening 123. As illustrated in FIG. 2, mating member 210 is mated with opening 123 of one of retainers 122; and mating member 110 is mated with opening 123 of the other of retainers 122. Retainers 122 restrict the movement of getter structure 114 within the plane defined by frame 109, and they allow ease of placement of getter structure 114 within component capture frame 108.

Getter structure 214 also has a retainer 222 at each of a pair of opposed ends of a getter bar. Each of retainers 222 defines an opening (not shown). The opening of retainer 222 is a thin slot with which mating members 110 and 210 are mated. Retainers 222 restrict the movement of getter structure 214 within the plane defined by frame 109, and further restrict the movement of getter structure 214 in a direction perpendicular to the plane defined by frame 109.

Figure 3:
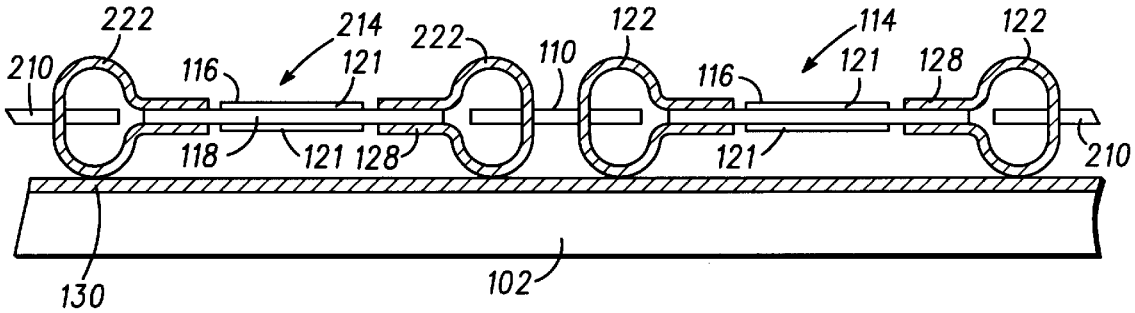
FIG. 3 is a view taken along the section lines 3—3 of FIG. 2.

FIG. 3 is a view taken along the section lines 3—3 of FIG. 2. As illustrated in FIG. 3, each of retainers 122 and 222 of getter structures 114 and 214, respectively, form a loop, the ends of which are attached to getter bar 116.

Getter bar 116 includes a substrate 118, which can be made from a metal. For example, substrate 118 can be made from stainless steel. As illustrated in FIG. 3, a getter 121 is affixed to each of the opposing surfaces of substrate 118. Getter materials useful for field emission devices are known to one skilled in the art.

Further illustrated in FIG. 3 is a grounding layer 130, which is disposed on cathode plate 102. Grounding layer 130 is made from a convenient conductive material and is in electrical contact with retainers 122 and 222. Grounding layer 130 is connected to a voltage source (not shown) for controlling the potential at retainers 122 and 222.

Figure 4:
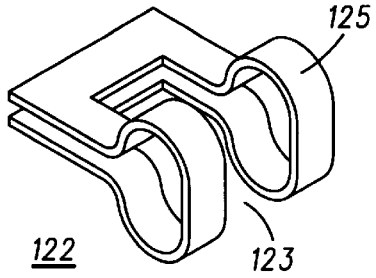
FIG. 4 is a perspective view of a retainer in accordance with the preferred embodiment of the invention.

FIG. 4 is a perspective view of retainer 122 in accordance with the preferred embodiment of the invention. Retainer 122 is made from a layer 125, which defines opening 123. A first end of layer 125 is attached to one of the opposing surfaces of substrate 118 using a convenient attachment method, such as mechanical attachment, metal bonding, and the like. The opposing end of layer 125 is attached to the other of the opposing surfaces of substrate 118, as illustrated in FIG. 3.

As further illustrated in FIG. 3, each of the ends of layer 125, which is attached to substrate 118, defines a standoff 128. A standoff embodying the invention is provided to ensure that getter 121 is spaced apart from anode plate 104 and/or cathode plate 102 subsequent to the evacuation and sealing of the package.

Figure 5:
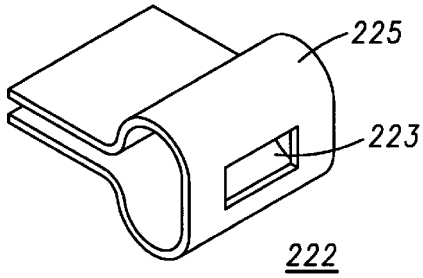
FIG. 5 is a perspective view of a retainer in accordance with another embodiment of the invention.

FIG. 5 is a perspective view of retainer 222 in accordance with another embodiment of the invention. As described above, retainer 222 defines an opening 223, which is now illustrated in FIG. 5. Retainer 222 is made from a layer 225, which defines opening 223. Retainer 222 is attached to getter bar 116 in a manner similar to that of retainer 122.

Figure 6:
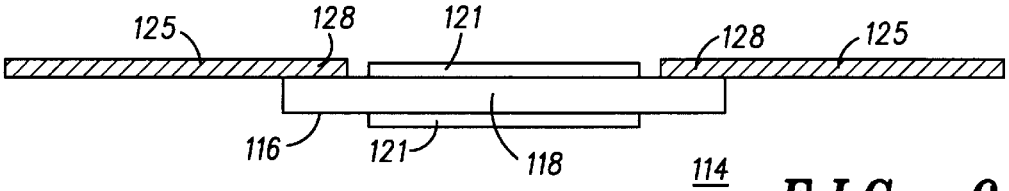
FIG. 6 is a side elevational view of a getter structure in accordance with the preferred embodiment of the invention.

FIG.6 is a side elevational view of getter structure 114 in accordance with the preferred embodiment of the invention. Illustrated in FIG. 6 is the attachment of one of the ends of each of layers 125 to getter bar 116. Subsequent to the attachment of the first end of layer 125 to substrate 118, layer 125 is shaped into a loop, and the remaining end is attached to substrate 118.

Retainers 122 and 222 are shaped to allow openings 123 and 223, respectively, to be mated with mating members 210 and 110, as illustrated in FIGS. 2 and 3. The mated configuration of retainers 122 and 222 prevent getter bars 116 from sliding underneath frame 109 during the packaging and sealing steps in the fabrication of FED 100.

Prior to sealing the package elements of FED 100, the elements, including sealant 107, are assembled in the desired configuration. Components 113 are mated with component capture frame 108. Component capture frame 108, having the mated components, is placed upon a surface of one of anode plate 104 or cathode plate 102. Sealant 107 is placed between the display plates and frame 109. The remaining display plate is placed upon sealant 107.

In this initial configuration, sealant 107 creates a separation distance between display frame 106 and each of anode plate 104 and cathode plate 102. The pre-sealing separation distance is greater than the post-sealing separation distance. The difference is due to the spreading of sealant 107 during the sealing process. Retainers 122 and 222 prevent getter bars 116 from being displaced beneath frame 109 due to the initial greater separation distances.

During the sealing process, the spreading of sealant 107 causes a reduction in the separation distance between anode plate 104 and cathode plate 102. As anode plate 104 and cathode plate 102 are displaced toward one another, retainers 122 and 222 are compressed.

The dimensions of the package elements can be selected such that the retainers are compressed to an extent that allows standoffs 128 to make physical contact with cathode plate 102 and/or anode plate 104. The thickness of each of standoffs 128 is greater than the thickness of getter 121. Thus, standoffs 128 ensure that getter 121 is exposed to the vacuum environment within FED 100. In the embodiments of FIGS. 3–6, each standoff element is derived from an end portion of a retainer element.

Figure 7:
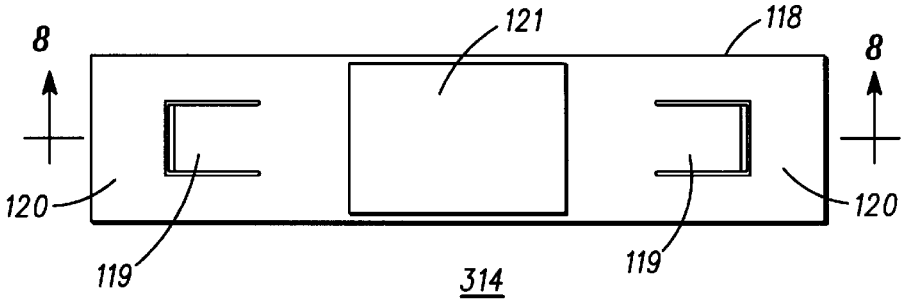
FIG. 7 is a top plan view of a structure useful for making a getter structure having an integral retainer in accordance with yet another embodiment of the invention.

FIG. 7 is a top plan view of a structure useful for making a getter structure 314 having an integral retainer in accordance with yet another embodiment of the invention. The embodiment of FIG. 7 has a standoff element that is coextensive with the substrate of the getter bar, and further has a retainer element that is coextensive with the substrate of the getter bar.

As illustrated in FIG. 7, substrate 118 defines, at each of its opposing ends, a substrate tab 119 and a substrate loop 120. Getter 121 is affixed on the opposing surfaces of substrate 118 between substrate tabs 119.

Figure 8:
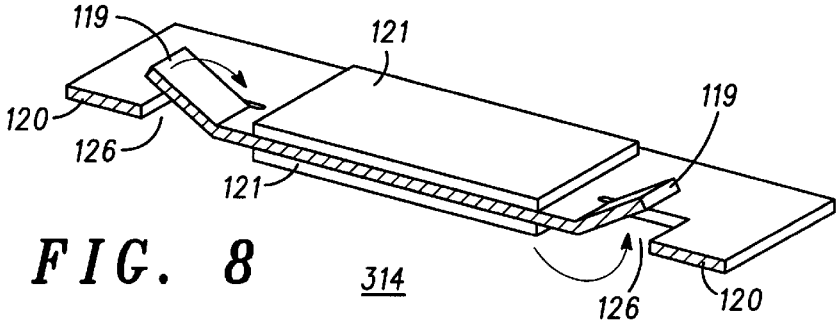
FIG. 8 is a perspective cross-sectional view taken along the section lines 8—8 of FIG. 7.
Figure 9:
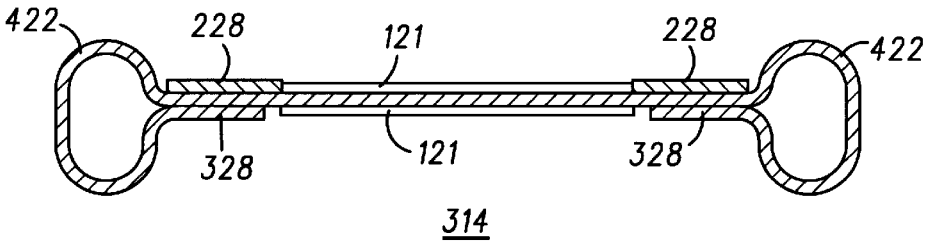
FIG. 9 is a side elevational view of the getter structure derived from the structure of FIG. 7.

FIG. 8 is a perspective cross-sectional view taken along the section lines 8–8 of FIG. 7, and FIG. 9 is a side elevational view of getter structure 314. Illustrated in FIG. 9 are the final configurations of substrate tab 119 and substrate 120. To arrive at the configuration of FIG. 9, and as indicated by arrows in FIG. 8, substrate tab 119 is folded out of the plane defined by substrate 118. Substrate tab 119 is then affixed to a portion of substrate 118 adjacent to getter 121 by using a convenient metal bonding method, such as welding. In this manner, a standoff 228, as shown in FIG. 9, is formed. Standoff 228 is coextensive with substrate 118.

Also, an opening 126 is thus defined by substrate 118 at the pre-folding location of each of substrate tabs 119. Openings 126 are useful for mating getter structure 314 with mating members of a component capture frame, in accordance with the invention.

Additionally, substrate loop 120 is shaped into a loop. The end portion of substrate loop 120 is affixed to substrate 118. In this manner, a retainer 422 and a standoff 328, as shown in FIG. 9, are formed. Standoff 328 is made from an end portion of retainer 422.

Figure 10:
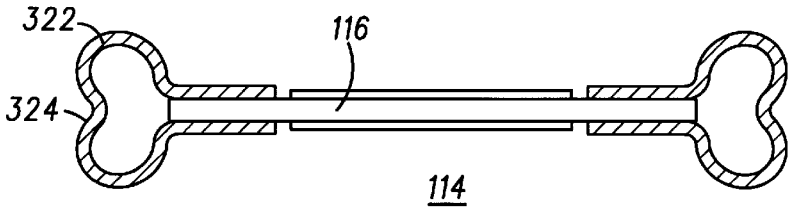
FIG. 10 is a side elevational view of a getter structure having a retainer, which defines a notch, in accordance with still another embodiment of the invention.

FIG. 10 is a side elevational view of getter structure 114 having a retainer 322, which defines a notch 324, in accordance with still another embodiment of the invention. Notch 324 is formed by selectively compressing a looped retainer at its central portion. The looped retainer can be formed in a manner similar to that described with reference to retainer 122, 222, or 422 of FIGS. 3–9. Retainer 322 provides the benefit of reduced elongation of getter structure 114 during the sealing process in the fabrication of FED 100. In this manner, the volume occupied by getter structure 114 within FED 100 is reduced.

Figure 11:
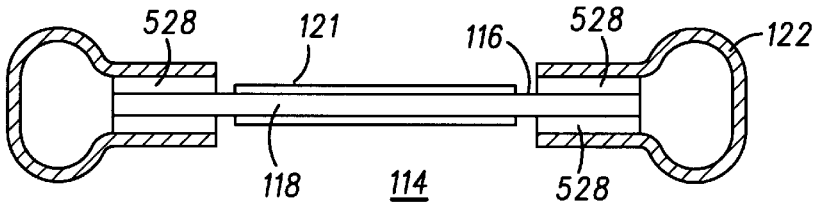
FIG. 11 is a side elevational view of a getter structure having a plurality of standoffs that are pads, in accordance with yet still another embodiment of the invention.

FIG. 11 is a side elevational view of getter structure 114 having a plurality of standoffs 528 that are pads, in accordance with yet still another embodiment of the invention. Standoffs 528 of the embodiment of FIG. 11 are pads or layers, which are affixed at the ends of the opposing surfaces of substrate 118. Standoffs 528 can be made from getter material that is screen-printed onto substrate 118. Alternatively, standoffs 528 can be made from metal layers that are welded onto substrate 118.

In accordance with the invention, standoffs 528 are also useful for getter structures that do not include retainers. The absence of a retainer results in the end portion of the retainer not being available to provide a standoff function. As described above, the standoff function ensures exposure of getter 121 to the vacuum within FED 100. Therefore, standoffs 528 are useful for spacing apart getter 121 from anode plate 104 and cathode plate 102 when there is no retainer.

Figure 12:
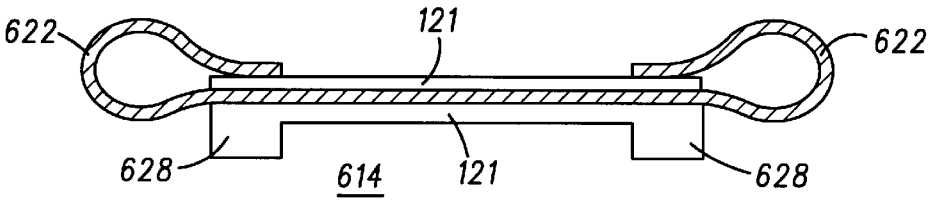
FIG. 12 is a side elevational view of a getter structure having a retainer that contacts either the cathode plate or the anode plate, in accordance with a further embodiment of the invention.

FIG. 12 is a side elevational view of a getter structure 614 having a retainer 622 that contacts either cathode plate 102 or anode plate 104, in accordance with a further embodiment of the invention. In the embodiment of FIG. 12, retainer 622 is shaped such that it physically contacts only one of the display plates, at least during the initial assembly step, prior to sealing of the package. Retainer 622 defines an opening (not shown) designed to be mated with a mating member of a component capture frame, in accordance with the invention. Further, in the embodiment of FIG. 12, retainer 622 is affixed at one end to getter 121.

Getter structure 614 also includes a plurality of standoffs 628, which are affixed to one of the opposing surfaces of substrate 118. Standoffs 628 are coextensive with and thicker than getter 121.

Figure 13:
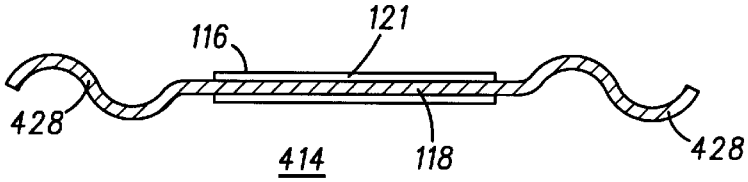
FIG. 13 is a side elevational view of a getter structure having an S-shaped standoff, in accordance with yet a further embodiment of the invention.

FIG. 13 is a side elevational view of a getter structure 414 having a standoff 428, which is S-shaped, in accordance with yet a further embodiment of the invention. In the embodiment of FIG. 13, standoff 428 is coextensive with substrate 118 of getter bar 116. Standoff 428 is derived from the layer from which substrate 118 is made. The end of the layer is bent and shaped to provide standoff 428.

Getter structure 414 is mated with a mating member of a component capture frame in accordance with the invention. For example, a mating configuration can be used that is similar to that shown for mating member 510 of FIG. 2.

Alternatively, standoff 428 can be made from a layer that has an opening, similar to opening 123 as illustrated in FIG. 4. One opening is formed at each of the opposing ends of the layer. The portion of the layer having the opening is shaped to form standoff 428. The opening of standoff 428 is mated with a mating member, such as mating members 110 and 210 of FIG. 2, of the component capture frame.

Figure 14:
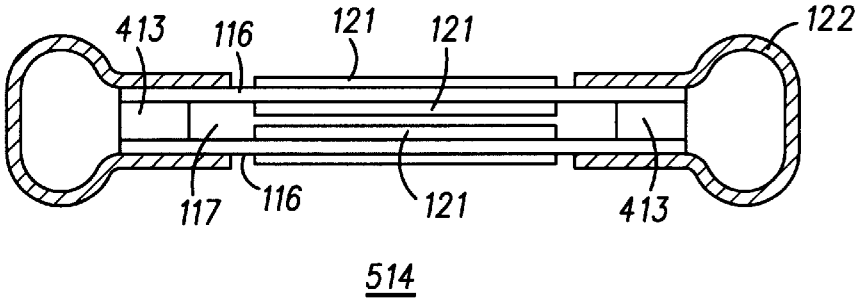
FIG. 14 is a side elevational view of a getter structure having multiple getter bars, in accordance with still a further embodiment of the invention.

FIG. 14 is a side elevational view of a getter structure 514 having multiple getter bars 116, in accordance with still a further embodiment of the invention. In the embodiment of FIG. 14, getter bars 116 are spaced apart from one another by spacer layers 413. As illustrated in FIG. 14, an opening 117 is defined by getter bars 116 and spacer layers 413.

Spacer layers 413 are made from a convenient material, such as a getter material, layers of metal, and the like. Spacer layers 413 allow opposing getters 121 to be in communication with the vacuum environment of the field emission device, thereby providing efficient removal of gaseous contaminants by getters 121.

Figure 15:
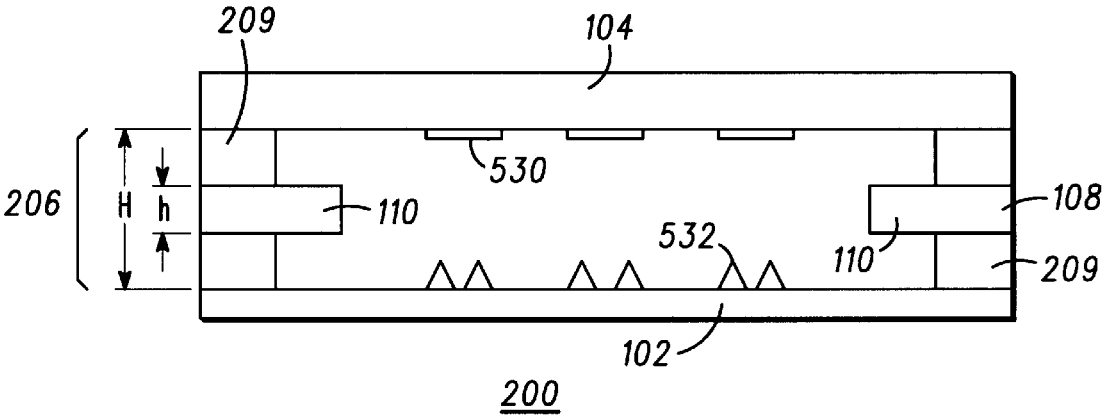
FIG. 15 is a cross-sectional view of a field emission display, in accordance with yet still a further embodiment of the invention.

FIG. 15 is a cross-sectional view of a field emission display 200, in accordance with yet still a further embodiment of the invention. The embodiment of FIG. 15 has a display frame 206, which includes component capture frame 108 and additional spacer frames 209. Display frame 206 has a height, H, which is greater than the height, h, of mating member 110.

Further illustrated in FIG. 15 are a plurality of electron emitters 532, of cathode plate 102, and a plurality of phosphors 530, of anode plate 104. Electrons emitted by electron emitters 532 selectively activate phosphors 530 for producing a display image. Methods for making cathode plates and anode plates for use in a field emission display are known to one skilled in the art.

Spacer frames 209 can be made from glass, and they are made in a manner similar to that of component capture frame 108. However, spacer frames 209 are not required to include mating members.

As illustrated in FIG. 15, one of spacer frames 209 is disposed between component capture frame 108 and cathode plate 102, and a second of spacer frames 209 is disposed between component capture frame 108 and anode plate 104. Spacer frames 209 can be affixed with a glass frit sealant (not shown).

In summary, the invention is for a field emission device having a component capture frame. The component capture frame of the invention provides numerous advantages, such as reduction in contaminant gases, ease of integration of dissimilar materials, and improved yield.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

What is claimed is:

1. A field emission device comprising:

a cathode plate having a plurality of electron emitters;

an anode plate disposed to receive electrons emitted by the plurality of electron emitters; and a component capture frame disposed between the cathode plate and the anode plate.

2. The field emission device as claimed in claim 1, further comprising a spacer frame disposed between the component capture frame and the cathode plate.

3. The field emission device as claimed in claim 1, further comprising a spacer frame disposed between the component capture frame and the anode plate.

4. A field emission device comprising:

a cathode plate having a plurality of electron emitters;

an anode plate disposed to receive electrons emitted by the plurality of electron emitters;

a frame interposed between the cathode plate and the anode plate;

a mating member coextensive with the frame; and a component mated with the mating member.

5. The field emission device as claimed in claim 4, further comprising a spacer frame disposed between the frame and the cathode plate.

6. The field emission device as claimed in claim 4, further comprising a spacer frame disposed between the frame and the anode plate.

7. The field emission device as claimed in claim 4, wherein the component has a retainer disposed in abutting engagement with at least one of the cathode plate and the anode plate.

8. The field emission device as claimed in claim 7, further comprising a grounding layer in electrical contact with the retainer, and wherein the retainer comprises a conductive material.

9. The field emission device as claimed in claim 7, wherein the retainer defines an opening, and wherein the opening of the retainer is mated with the mating member.

10. The field emission device as claimed in claim 7, wherein the retainer defines a notch.

11. The field emission device as claimed in claim 4, wherein the component comprises a getter structure.

12. The field emission device as claimed in claim 11, wherein the getter structure comprises a substrate having opposed surfaces and further comprises a getter disposed upon at least one of the opposed surfaces of the substrate.

13. The field emission device as claimed in claim 12, wherein the getter structure further comprises a retainer.

14. The field emission device as claimed in claim 13, wherein the retainer comprises a substrate loop.

15. The field emission device as claimed in claim 12, wherein the getter structure further comprises a standoff affixed to the substrate, whereby the getter is spaced apart from at least one of the anode plate and the cathode plate by the standoff.

16. The field emission device as claimed in claim 15, wherein the standoff comprises an end portion of the retainer.

17. The field emission device as claimed in claim 15, wherein the standoff is coextensive with the substrate.

18. The field emission device as claimed in claim 17, wherein the standoff comprises a substrate tab.

19. The field emission device as claimed in claim 17, wherein the standoff is S-shaped.

20. The field emission device as claimed in claim 11, wherein the getter structure comprises a first getter bar, a second getter bar, and a spacer layer interposed between the first and second getter bars.

21. The field emission device as claimed in claim 4, wherein the mating member comprises a tab.

22. The field emission device as claimed in claim 4, wherein the mating member comprises a finger-like protrusion.

23. The field emission device as claimed in claim 4, wherein the mating member is hook-shaped.

24. The field emission device as claimed in claim 4, wherein the mating member is knob-shaped.

25. The field emission device as claimed in claim 4, wherein the mating member defines a notch.

26. A field emission device comprising:

a cathode plate having a plurality of electron emitters;

an anode plate disposed to receive electrons emitted by the plurality of electron emitters;

a frame interposed between the cathode plate and the anode plate and defining a central opening;

a mating member coextensive with the frame and disposed within the central opening; and a component mated with the mating member.

27. The field emission device as claimed in claim 26, further comprising a spacer frame disposed between the frame and the cathode plate.

28. The field emission device as claimed in claim 26, further comprising a spacer frame disposed between the frame and the anode plate.

29. The field emission device as claimed in claim 26, wherein the component has a retainer disposed in abutting engagement with at least one of the cathode plate and the anode plate.

30. The field emission device as claimed in claim 29, further comprising a grounding layer in electrical contact with the retainer, and wherein the retainer comprises a conductive material.

31. The field emission device as claimed in claim 29, wherein the retainer defines an opening, and wherein the opening of the retainer is mated with the mating member.

32. The field emission device as claimed in claim 29, wherein the retainer defines a notch.

33. The field emission device as claimed in claim 26, wherein the component comprises a getter structure.

34. The field emission device as claimed in claim 33, wherein the getter structure comprises a substrate having opposed surfaces and further comprises a getter disposed upon at least one of the opposed surfaces of the substrate.

35. The field emission device as claimed in claim 34, wherein the getter structure further comprises a retainer.

36. The field emission device as claimed in claim 35, wherein the retainer comprises a substrate loop.

37. The field emission device as claimed in claim 34, wherein the getter structure further comprises a standoff affixed to the substrate, whereby the getter is spaced apart from at least one of the anode plate and the cathode plate by the standoff.

38. The field emission device as claimed in claim 37, wherein the standoff comprises an end portion of the retainer.

39. The field emission device as claimed in claim 37, wherein the standoff is coextensive with the substrate.

40. The field emission device as claimed in claim 39, wherein the standoff comprises a substrate tab.

41. The field emission device as claimed in claim 39, wherein the standoff is S-shaped.

42. The field emission device as claimed in claim 33, wherein the getter structure comprises a first getter bar, a second getter bar, and a spacer layer interposed between the first and second getter bars.

43. The field emission device as claimed in claim 26, wherein the mating member comprises a tab.

44. The field emission device as claimed in claim 26, wherein the mating member comprises a finger-like protrusion.

45. The field emission device as claimed in claim 26, wherein the mating member is hook-shaped.

46. The field emission device as claimed in claim 26, wherein the mating member is knob-shaped.

47. The field emission device as claimed in claim 26, wherein the mating member defines a notch.

48. A field emission display comprising:

a cathode plate having a plurality of electron emitters;

an anode plate having a plurality of phosphors disposed to receive electrons emitted by the plurality of electron emitters; and a component capture frame disposed between the cathode plate and the anode plate.

* * * * *